US006788907B1

(12) United States Patent
Burkes et al.

(10) Patent No.: US 6,788,907 B1
(45) Date of Patent: Sep. 7, 2004

(54) APPARATUS AND METHOD FOR MANAGING PRINTING MODE SWITCHING IN A PRINTING APPARATUS

(75) Inventors: Theresa A. Burkes, Meridian, ID (US); Ben B. Tyson, Eagle, ID (US); James E. Anderson, Meridian, ID (US); David E. Smith, Emmett, ID (US); Michael J. Borg, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 4 days.

(21) Appl. No.: 10/418,890

(22) Filed: Apr. 18, 2003

(51) Int. Cl.[7] ..... G03G 15/00
(52) U.S. Cl. ..... 399/82; 399/44; 399/85
(58) Field of Search ..... 399/44, 81, 82, 399/83, 85

(56) References Cited

U.S. PATENT DOCUMENTS 6,636,711 B1 * 10/2003 Katahira ..... 399/82
6,751,425 B2 * 6/2004 Fujimori et al. ..... 399/82

* cited by examiner

*Primary Examiner*—Fred Braun

(57) ABSTRACT

A printing apparatus is provided which includes a print mechanism configured to print in a plurality of color modes, and a controller configured to select an active color mode switching option from among a plurality of color mode switching options, and instruct the print mechanism to switch between the color modes according to the active color mode switching option. Each of the color mode switching options defines a manner in which the printing apparatus and method will switch between the plurality of color modes when printing a document.

44 Claims, 3 Drawing Sheets

APPARATUS AND METHOD FOR MANAGING PRINTING MODE SWITCHING IN A PRINTING APPARATUS

BACKGROUND

Many printers have distinct color and monochrome print modes, each of which may be capable of printing pages at equal speed. Monochrome pages may typically be printed in either the monochrome or full-color mode, while color pages may be printed only in the full-color mode. Printing monochrome pages in the full-color mode may increase wear on consumables within the printer, such as toner cartridges, print drums, etc. For this reason, certain prior art printers print each color page of a print job in the full-color print mode and each monochrome page in the monochrome print mode. However, switching print modes between pages of the print job in this manner causes delay and additional wear on printer parts and consumables.

DETAILED DESCRIPTION

Figure 1:
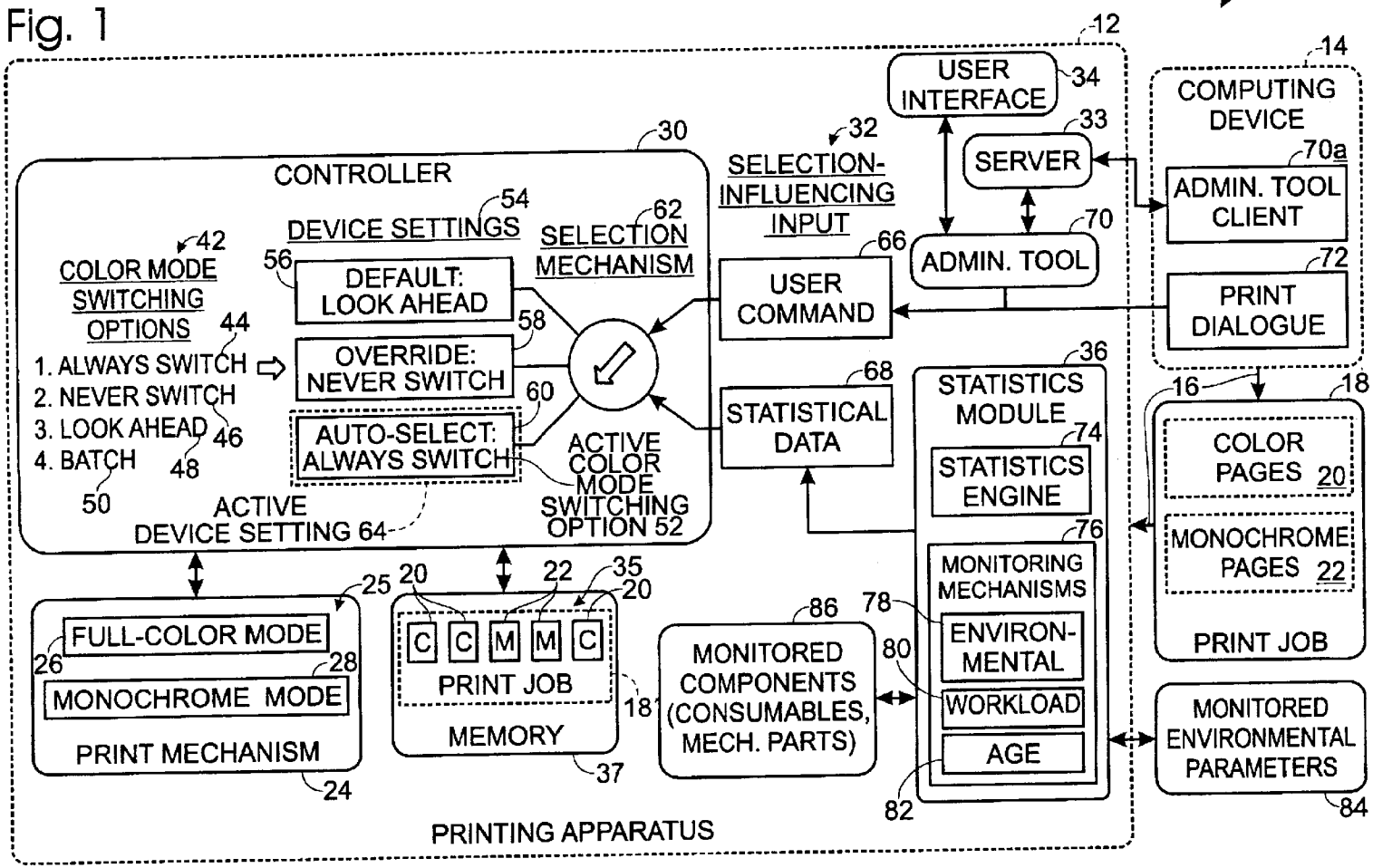
FIG. 1 is a schematic view of a printing system according to one embodiment of the invention.

FIG. 1 shows a printing system 10, including a printing apparatus 12 connected to a computing device 14 via a communications link 16. The printing apparatus is configured to receive a print job 18 containing both color pages 20 and monochrome pages 22 from the computing device 14 via the communications link. Printing apparatus 12 includes a print mechanism 24 configured to print the print job 18 using a plurality of color modes 25, such as a full-color mode 26 and a monochrome mode 28. Printing apparatus 12 further includes a controller 30 configured to instruct the print mechanism 24 to switch between the color modes 25 based on selection-influencing input 32 from an on-board source such as a user interface 34 or a statistics module 36, or from an external source such as computing device 14.

Figure 2:
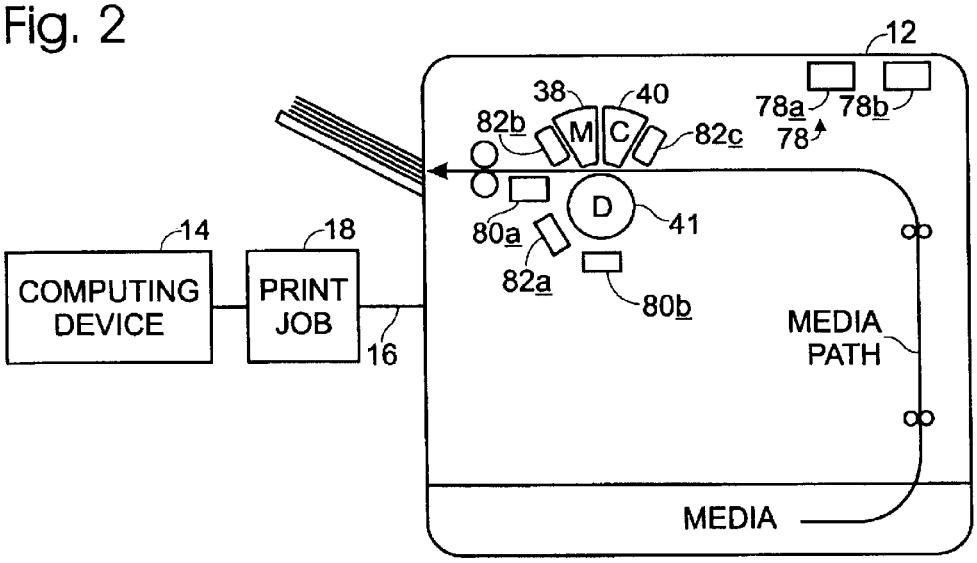
FIG. 2 is a schematic view of the printing system of FIG. 1, showing a media path and consumables of a printing apparatus of the printing system.

In full-color mode 26, print mechanism 24 is configured to print both color pages 20 and monochrome pages 22, using both a monochrome print cartridge 38 and a color print cartridge 40, both shown in FIG. 2. In monochrome mode 28, print mechanism 24 is configured to print monochrome pages 22, using only monochrome print cartridge 38. Printing color pages 20 in the monochrome mode generally will result in the color pages being printed in grayscale. The term "color page" as used herein refers to any page containing non-black or non-grayscale content, while the term "monochrome page" refers to any page containing only grayscale and/or black-and-white content.

Typically, color print cartridge 40 is a full-color cartridge, including cyan, magenta, and yellow print elements configured to print in a full spectrum of color. A single print drum 41 may be employed, which may perform a separate rotation for each color being applied to the media. Alternatively, three separate cyan, magenta, and yellow print cartridges may be provided, each of which may have its own print drum. These separate color print cartridges may be positioned with the monochrome cartridge in series, or "in line," along the media path, such that each cartridge applies its toner to the media to create a full-color image. A printing apparatus of this configured may be referred to as an "in-line" color laser printer. Typically, monochrome print cartridge 40 is configured to print only in black, although the cartridge may alternatively be configured to print in a single color other than black.

Printing monochrome pages 22 in full-color mode 26 may result in more wear on consumables such as toner in color print cartridge 40, than does printing monochrome pages 22 in the monochrome mode 28. Thus, where a print job includes both full-color and monochrome pages it may be desirable to switch between the full-color and monochrome modes 26, 28 while printing a print job, rather than printing all monochrome pages in the full-color mode. On the other hand, switching between color modes 25 may cause some delay in printing, and also additional wear on printing apparatus components. The additional wear may be caused by the need to "spin down" (i.e. bring to a rotational stop) and "spin up" (i.e. bring to an operational rotating speed) the scanning mirror in print mechanism 24 in order to switch between the color modes. Thus, for certain documents it may be desirable to switch color modes less frequently, or not at all. In short, no one method of switching between color modes is optimal for all documents.

Controller 30 thus may be configured with a plurality of color mode switching options 42. The color mode switching options 42 typically include an always switch option 44, a never switch option 46, a look ahead option 48, and a batch option 50. Other color mode switching options may also be provided. When always switch option 44 is active, print mechanism 24 may be instructed by controller 30 to print all color pages 20 in full-color mode 26, and all monochrome pages 22 in monochrome mode 28. When never switch option 46 is active, the print mechanism may be instructed never to switch between color modes 25. Thus, all pages may be printed in whichever color mode 25 is active at the time when never switch option 46 is selected. When the look ahead option is active, the controller is configured to make a switching decision (i.e. a decision to switch from the full-color mode to the monochrome mode or vice versa) based upon upcoming print job pages 35, which the controller examines by accessing print job 18' in memory 37. The look ahead option may include a switching decision based on (a) the color content of upcoming pages, (b) whether a threshold number of color pages occurs consecutively, (c) which mode would optimize spin down (i.e., reduce the need to spin down the print mechanism), and/or a variety of other properties of print job pages 35. The batch option typically prints a plurality of print jobs, each of which are shorter than a predetermined threshold length, consecutively without spinning down the print mechanism, to avoid wear associated with spin down and subsequent spin up of the print mechanism between print jobs.

To enable the user to program the printing device to print in a desired manner, the controller also may be equipped with a plurality of device settings 54, each of which may be associated with one or more of the color mode switching options. Controller 30 is configured to receive a user selection of an active device setting 64, which has the effect of selecting an active color mode switching option 52. The user typically makes this selection via an administrative tool 70, shown in detail in FIG. 3, or via a print dialog interface 72. Printing apparatus 12 is configured to print the current print job according to the active color mode switching option 52 set by the active device setting 64.

Device settings 54 typically include a default setting 56, an override setting 58, and an automatic selection setting 60. In the depicted example, the default setting is set to the look ahead option, the override setting is set to the never switch option, and the automatic selection setting is set to the always switch option. Typically, the default setting and automatic selection setting are preset by the printing device manufacturer, while the override setting may be configured by the user via administrative tool 70 or print dialog interface 72, described below.

Controller 30 further includes a selection mechanism 62 configured to select an active device setting 64 from among the device settings 54, and also to make an automatic selection of a color mode switching option when the automatic selection setting 60 is selected. Selection mechanism is configured to receive a user command 66 from an administrative tool 70 or print dialog interface 72, as discussed above, and select the active device setting 64 based on the user command. For the default setting 56 and override setting 58, selection of the active device setting has the effect of selecting the active color mode switching option 52, since typically only one color mode switching option is associated with each of these device settings. For the automatic selection setting 60, selection mechanism 62 further is configured to make the automatic selection of an active color mode switching option, based on statistical data 68 received from statistics module 36. Collectively, user command 66 and statistical data 68 are referred to as selection influencing input 32. Selection mechanism 62 is typically preprogrammed to choose default setting 56 as the active device setting 64 upon installation of printing apparatus 12. The user may select the automatic selection setting 60 or the override setting 58 via administrative tool 70 or print dialog interface 72.

Administrative tool 70 may be configured to enable a user to access and program various performance parameters of printing apparatus 12. Administrative tool 70 is typically executed by controller 30 on board printing apparatus 12 and accessed via an on-board user interface 34 such as a control panel. Administrative tool 70 alternatively may be accessed via an administrative tool client 70*a* executed on computing device 14, which accesses administrative tool 70 via an on-board server 33 on printing apparatus 12. On-board server 33 is typically an embedded web server, configured to communicate with client 70*a* using HTTP and TCP/IP protocols.

Figure 3:
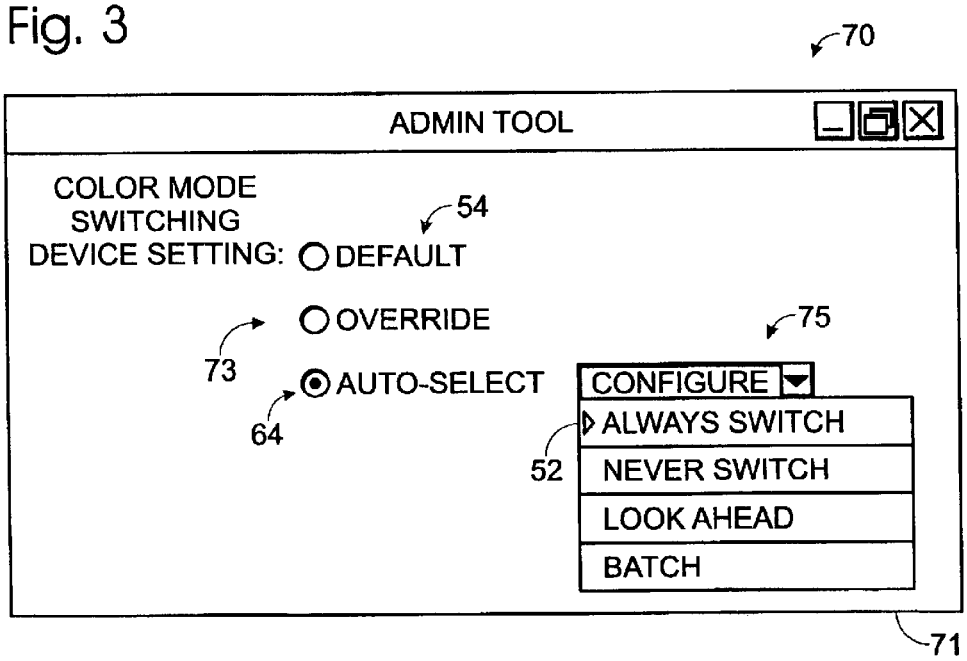
FIG. 3 is a schematic view of a user interface of an administrative tool and print dialog interface of the printing system of FIG. 1.

As shown in FIG. 3, administrative tool 70 may include a user interface 71 having a device setting selector 73 via which a user may select an active device setting 64 from among device settings 54. In addition, user interface 71 may include a color mode switching option selector 75 via which a user may select an active color mode switching option 52 for the user configurable override device setting 58. User interface 71 may be displayed via printing apparatus user interface 34 (e.g. when displayed on a control panel of the printing apparatus), or via a display of computing device 14 (e.g. when accessed via embedded web server in the printing apparatus).

In addition to administrative tool 70, a user may also select an active device setting 64 for color mode switching via a print dialog interface 72. The print dialog interface typically is presented by computing device 14 when the user selects a "print" command in a particular application. It will be appreciated that print dialog interface 72 typically includes a user interface in substantially the same form as user interface 71 of administrative tool 70, and thus will not be re-described in detail. The print dialog interface also typically includes other user interface elements that enable a user to adjust printing parameters such as page range, orientation, number of copies, and color or grayscale. In addition print dialog interface 72 includes selectors similar to selectors 73 and 75, which enable a user to select an active device setting 64 and specify an active color mode switching option 52 for the user-configurable override device setting.

Printing apparatus 12 further includes a statistics module 36 having a statistics engine 74 configured to receive signals from a plurality of monitoring mechanisms 76 and record statistical data for a variety of operational parameters monitored by monitoring mechanisms 76. Monitoring mechanisms 76 typically include one or more environmental sensors 78 configured to sense an environmental parameter 84, one or more workload monitors 80 configured to track a workload parameter of a monitored printing apparatus component 86, and/or one or more age monitors 82 configured to determine an age parameter of a monitored printing apparatus component 86, or of the printing apparatus itself. It will be appreciated that monitoring mechanisms 76 may be implemented using hardware and/or software, and thus may include hardware sensors configured to measure physical parameters and/or software routines configured to query a data stream or memory location in order to identify a parameter such as page count, elapsed time, etc.

As shown in FIG. 2, environmental sensors 78 may include temperature sensor 78*a* and humidity sensor 78*b*, respectively configured to measure the environmental parameters of temperature and humidity of the operating environment of printing apparatus 12.

Workload monitors 80 may include a page count monitor 80*a* configured to count a total number of pages, a number of color pages, and a number of monochrome pages printed by printing apparatus 12 within a predetermined period of time, over the life of the printing apparatus, or over the life of a particular component of the printing apparatus. In addition, workload monitors 80 may include a cycles-of-use monitor 80*b* configured to determine a number of cycles of use for a monitored printing apparatus component 86 of printing apparatus 12, such as print drum 41.

Age monitors 82 may include print drum age monitor 82*a*, monochrome print cartridge age monitor 82*b*, and color print cartridge age monitor 82*c*, which are respectively configured to measure an age of each of these components. Age may be measured as remaining page count, remaining time, or remaining capacity for each component. For example, each component may have ratings, typically assigned by the manufacturer, corresponding to a useful lifetime for the component expressed in number of pages and/or time of use. The remaining page count may be a rated number of pages for the component (i.e. the number of pages that the component is rated by the manufacturer as able to print during its useful lifetime) minus a number of pages printed to date by the component. Remaining time may be a rated time (i.e., the useful lifetime for which a component is rated by the manufacturer) minus a time since installation of the component. Remaining capacity may be a percentage of toner remaining in the print cartridges. Typically, this is determined based on data received from a toner sensor that measures toner in each cartridge.

Thus, age monitors 82 are configured to count pages, count time, and sense consumable levels such as toner levels. Typically, the age monitors include hardware sensors used to sense toner levels, and to sense when a particular component is installed, as well as software-based sensing mechanisms used to count pages and count time. These age parameters are periodically stored in memory by the controller, and converted into age statistics data by statistics module 36.

As described above, monitored printing apparatus components 86, for which age and/or workload statistics are monitored, may include consumable components such as a color print cartridge, monochrome print cartridge and print drum, or non-consumable components, such as mechanical components of the printing apparatus that are in motion during printing, color mode switching, spin up, or spin down (e.g. rollers, gear drives, etc.).

Data from the various monitoring mechanisms 76 may be sent to statistics engine 74 for processing. Statistics engine 74, in turn may compile statistical data 68, which typically includes statistics for the age, workload, and environmental parameters discussed above. Selection mechanism 62 of printing apparatus 12 is configured to select an active color mode switching option 52 based on the statistical data, when the printing apparatus is set to the automatic selection device setting 60. Thus, in the automatic selection setting, the printing apparatus may select the most appropriate color mode switching option 42, based on the recorded environmental, workload, and/or age statistics in statistical data 68. The program logic for choosing the most appropriate mode is typically stored in memory accessible by controller 30.

The performance of many printing apparatus components is dependent on the above discussed environmental, workload, and age parameters. For example, a toner cartridge may be less efficient at printing when only a small percentage of toner is remaining, or when the printer is placed in a high humidity or high temperature environment. Thus, the program logic may be configured, for example, to set a color mode switching option based on a percent of remaining toner in a print cartridge, or an average humidity or temperature measured over a predetermined time period (e.g. one week or one month). As another example, where workload statistics are measured showing that a particular printer typically receives many short print jobs containing color, the program logic may be configured to set the color mode to full-color and select a batch print mode. Also, where workload statistics show that a print job with a first page that is color, also typically contains a subsequent threshold number of color pages, the program logic may be configured to set the color mode to the full-color mode, and select the never switch option, to ensure that the entire print job is printed in the full-color mode. A variety of other applications and settings are also possible.

Figure 4:
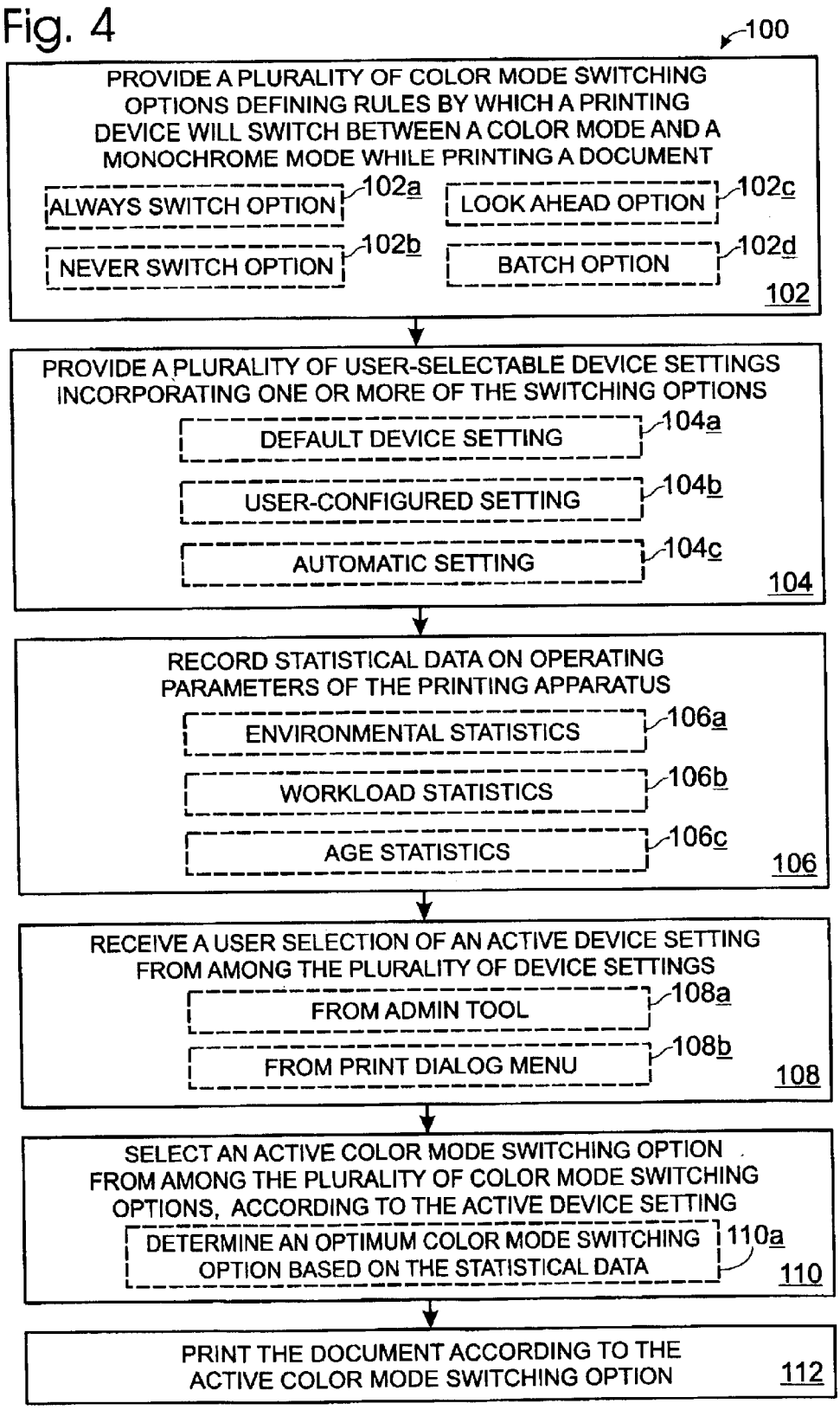
FIG. 4 is a flowchart of a method according to one embodiment of the present invention.

FIG. 4 shows a method 100 for use in printing a print job on a printing apparatus having a full-color mode and a monochrome mode, according to one embodiment of the present invention. At 102, the method typically includes providing a plurality of color mode switching options defining rules by which the printing apparatus will switch between the full-color-mode and monochrome mode while printing the print job. As shown at 102*a*–102*d*, the method may include providing an always switch option, providing a never switch option, providing a look ahead option, and/or providing a batch option, as described above.

At 104, the method typically includes providing a plurality of user-selectable device settings incorporating one or more of the switching options. As shown at 104*a*–104*c*, the method may included providing a default device setting, providing a user-configured device setting, and providing an automatic selection setting, as described above.

At 106, the method further may include recording statistical data related to operating parameters of printing apparatus 12. As shown at 106*a*–106*c*, the method may include recording environmental statistics for environmental parameters such as temperature and humidity, recording workload statistics such as numbers of pages printed and cycles of use of various printing apparatus components, as well as recording age statistics for various printing apparatus components, as discussed above.

At 108, the method further includes receiving a user selection of an active device setting from among the plurality of device settings. As shown at 108*a*, the method may include receiving the user selection from an administrative tool, the user interacting with the administrative tool either via an on-board user interface, or via an administrative client and embedded server. As shown at 108*b*, the method may include receiving the user selection from a print dialog interface presented on a computing device.

At 110, the method further may include selecting an active color mode switching option from among the plurality of color mode switching options. Where the printing apparatus is set to a default setting or user-configured override setting, selecting the active color mode switching option at 110 is accomplished by a controller looking up the color switching mode that has been associated with the device setting, either according to factory default settings or as adjusted by the user via administrative tool or print dialog interface. Where the printing apparatus is set to automatic selection mode, selecting the active color mode switching option at 110 is accomplished using statistical data. Thus, as shown at 110*a*, the method may include determining an optimum color mode switching option based on the statistical data, according to program logic stored in memory, as described above, and selecting the optimum color mode switching option as the active color mode switching option.

At 112, the method further includes printing the print job according to the active color mode switching option. While printing the print job, the printing apparatus may look ahead, according to look ahead option, and make a switching decision based on the content of upcoming pages in the print job, as described above. The print apparatus may be configured to examine (a) the color content of upcoming pages, (b) whether a threshold number of color pages occurs consecutively, (c) which mode would optimize spin down (i.e., reduce the need to spin down the print mechanism), and/or a variety of other properties of print job pages 35, as described above.

The embodiments of the present invention have industrial applicability to the printing apparatus industry, and enable a user to more effectively manage color mode switching in a printing apparatus. Furthermore, the foregoing operational principals may be applied to a variety of types of printing device, including ink devices, liquid toner devices, dry toner devices, etc.

While the present invention has been particularly shown and described, those skilled in the art will understand that many variations may be made therein without departing from the spirit and scope defined in the following claims. The description should be understood to include all novel and non-obvious combinations of elements described herein, and claims may be presented in this or a later application to any novel and non-obvious combination of these elements. Where the claims recite "a" or "a first" element or the equivalent thereof, such claims should be understood to include incorporation of one or more such elements, neither requiring nor excluding two or more such elements.

What is claimed is:

1. A printing apparatus, comprising:

a print mechanism configured to print in a plurality of color modes; and a controller configured to select an active color mode switching option from among a plurality of color mode switching options, and instruct the print mechanism to switch between the color modes according to the active color mode switching option;

wherein each of the color mode switching options defines a manner in which the printing apparatus will switch between the plurality of color modes when printing a document.

2. The apparatus of claim 1, wherein the plurality of color modes includes a monochrome mode and a full-color mode.

3. The apparatus of claim 2, wherein the print mechanism is configured to print both monochrome and color in the full-color mode, and is configured to print only monochrome in the monochrome mode.

4. The printing apparatus of claim 1, wherein the plurality of color mode switching options includes a never switch option, in which the print mechanism is instructed never to switch color modes.

5. The printing apparatus of claim 2, wherein the plurality of color mode switching options includes an always switch option, in which the print mechanism is instructed to print all color pages in the full-color mode, and all monochrome pages in the monochrome mode.

6. The printing apparatus of claim 2, wherein the plurality of color mode switching options includes a look ahead option, in which a switching decision to switch between the full-color mode and the monochrome mode is made based upon upcoming pages in the print job.

7. The printing apparatus of claim 6, wherein the look ahead option includes a switching decision based upon the color content of upcoming pages.

8. The printing apparatus of claim 7, wherein the look ahead option includes a switching decision based upon whether a threshold number of color pages occurs consecutively.

9. The printing apparatus of claim 6, wherein the look ahead option includes a switching decision based upon reducing wear and delay due to spin down.

10. The printing apparatus of claim 1, wherein the controller is configured with a plurality of device settings, each device being associated with one or more color mode switching options.

11. The printing apparatus of claim 10, wherein the controller is configured with a default device setting having a corresponding color mode switching option that is configured to be active upon installation of the printing apparatus.

12. The printing apparatus of claim 10, wherein the controller is configured with an override device setting that is configurable by a user to be associated with a user-selected color mode switching option.

13. The printing apparatus of claim 10, wherein the controller is configured with an automatic selection setting, in which the controller is configured to automatically select a color mode switching option.

14. The printing apparatus of claim 13, further comprising a statistics module configured to compile statistical data related to an operational parameter of the printing apparatus, and wherein, according to the automatic selection setting, the controller is configured to select a color mode switching option based on the statistical data.

15. The printing apparatus of claim 14, further comprising a workload monitor linked to the controller, the workload monitor being configured to determine a workload parameter, and the statistics module being configured to compile workload statistics based on the workload parameter.

16. The printing apparatus of claim 15, wherein the workload parameter is selected from a group consisting of cycles of use of a printing apparatus component, total number of pages printed, number of color pages printed, and number of monochrome pages printed over a predetermined period of time.

17. The printing apparatus of claim 14, further comprising an environmental sensor linked to the controller, the environmental sensor being configured to sense an environmental parameter, and the statistics module being configured to compile environmental statistics based on the environmental parameter.

18. The printing apparatus of claim 17, wherein the environmental parameter is selected from a group consisting of temperature and humidity.

19. The printing apparatus of claim 14, further comprising an age monitor linked to the controller, the age monitor being configured to sense an age parameter, and the statistics module being configured to compile age statistics based on the age parameter.

20. The printing apparatus of claim 17, wherein the age parameter measures the age of a printing apparatus component.

21. The printing apparatus of claim 20, wherein the age of the printing apparatus component is expressed as a parameter selected from a group consisting of remaining page count, remaining time, and remaining capacity for the printing apparatus component.

22. A printing apparatus, comprising:

a print mechanism configured to print a print job on a print medium;

a statistics engine configured to record statistical data including statistics selected from a group consisting of environmental statistics, workload statistics, and age statistics; and a controller configured to select a color mode switching option of the print mechanism based on the statistical data.

23. The printing apparatus of claim 22, wherein the print mechanism is configured to selectively print in a full-color mode or in a monochrome mode, and is configured to selectively switch between the full-color mode and monochrome mode according to color mode switching option.

24. The printing apparatus of claim 22, wherein the environmental statistics include statistics on parameters selected from a group consisting of temperature and humidity.

25. The printing apparatus of claim 22, wherein the workload statistics include statistics selected from total number of pages printed, number of color pages printed, and number of monochrome pages printed.

26. The printing apparatus of claim 22, wherein the age statistics include statistics on an age parameter selected from a group consisting of remaining page count, remaining time, and remaining capacity for a printing apparatus component.

27. A method of printing a print job on a printing apparatus having a full-color mode and a monochrome mode, the method comprising:

providing a plurality of color mode switching options defining the manner in which the printing apparatus will switch between the full-color mode and monochrome mode while printing the print job;

selecting an active switching option from among the plurality of color mode switching options; and printing the print job according to the active switching option.

28. The method of claim 27, wherein the plurality of color mode switching options are selected from a group consisting of an always switch option, never switching option, a look ahead option, and a batch print option.

29. The method of claim 28, wherein the batch print option includes determining that each one of a plurality of print jobs are smaller than a threshold length, and printing the plurality of print jobs consecutively without spinning down the print mechanism of the printing apparatus.

30. The method of claim 27, further comprising:

providing a plurality of user-selectable device settings incorporating one or more of the switching options.

31. The method of claim 30, wherein providing a plurality of user-selectable device settings includes providing a default setting as one of the user-selectable device settings.

32. The method of claim 30, wherein providing a plurality of user-selectable device settings includes providing a user-configurable override setting as one of the user-selectable device settings.

33. The method of claim 30, wherein providing a plurality of user-selectable device settings includes providing an automatic selection setting as one of the user-selectable device settings, according to which the printing apparatus determines the active color mode switching option.

34. The method of claim 33, further comprising, recording statistical data related to an operating parameter of the printing apparatus.

35. The method of claim 34, further comprising, selecting the active color mode switching option based on the statistical data.

36. The method of claim 35, further comprising, recording environmental statistics related to the printing apparatus.

37. The method of claim 36, wherein the environmental statistics include statistical data on an environmental parameter that is selected from a group consisting of temperature and humidity.

38. The method of claim 35, recording workload statistics related to the printing apparatus.

39. The method of claim 38, wherein the workload statistics include statistical data on a workload parameter that is selected from a group consisting of cycles of use and page count.

40. The method of claim 35, further comprising recording age statistics related to the printing apparatus.

41. The method of claim 40, wherein the age statistics include statistical data on the age of an item selected from a group consisting of consumables, non-consumable printing apparatus components, and printing apparatus.

42. The method of claim 30, further comprising receiving a user selection of an active device setting from among the plurality of device settings.

43. The method of claim 42, wherein the user selection is received from an administrative tool for the printing apparatus.

44. The method of claim 42, wherein the user selection is received from a print dialog interface.

* * * * *